US005803033A

United States Patent [19]

Naruoka

[11] Patent Number: 5,803,033

[45] **Date of Patent: *Sep. 8, 1998**

[54] VALVE DRIVE APPARATUS FOR AN INTERNAL COMBUSTION ENGINE HAVING A CONVEX SHIM BETWEEN A CAM AND A VALVE

[75] Inventor: Takao Naruoka, Mishima, Japan

[73] Assignee: Toyota Jidosha Kabushiki Kaisha, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 755,885

[22] Filed: Dec. 2, 1996

[30] Foreign Application Priority Data

Nov. 8, 1996 [JP] Japan ..... 8-296746

[51] Int. Cl.[6] ..... F01L 1/12; F01L 13/00

[52] U.S. Cl. ..... 123/90.18; 123/90.28; 123/90.39; 123/90.48

[58] Field of Search ..... 123/90.15, 90.16, 123/90.17, 90.18, 90.27, 90.39, 90.44, 90.45, 90.48, 90.52, 90.28

[56] References Cited

U.S. PATENT DOCUMENTS

| | | | |
|---|---|---|---|
| 3,915,129 | 10/1975 | Rust et al. | 123/90.18 |
| 4,693,214 | 9/1987 | Titolo | 123/90.18 |
| 4,799,463 | 1/1989 | Konno | 123/90.44 |
| 4,850,311 | 7/1989 | Sohn | 123/90.18 |
| 4,909,197 | 3/1990 | Perr | 123/90.39 |
| 5,159,906 | 11/1992 | Fontichiaro et al. | 123/90.18 |
| 5,570,665 | 11/1996 | Regueiro | 123/90.48 |

FOREIGN PATENT DOCUMENTS

| | | |
|---|---|---|
| 58-63304 | 4/1983 | Japan . |
| 59-90711 | 5/1984 | Japan . |
| 3-42001 | 4/1991 | Japan . |
| 3-179116 | 8/1991 | Japan . |
| 4-12104 | 1/1992 | Japan . |
| 7-279631 | 10/1995 | Japan . |
| 1192099 | 5/1970 | United Kingdom . |

*Primary Examiner*—Weilum Lo
*Attorney, Agent, or Firm*—Kenyon & Kenyon

[57] ABSTRACT

A valve drive apparatus having a shim which is prevented from interfering with a cylinder head without decreasing abrasion resistance between the shim and a lifter contacting the shim. A three-dimensional cam includes a cam portion having a slanting cam surface inclined with respect to a rotational axis of the cam. The cam is movable along the rotational axis. The lifter transmits a force generated by a camming action of the cam to the valve. The lifter has a first surface contacting the valve and a second surface substantially opposite to the first surface. A shim is interposed between the cam and the lifter. The shim has a first surface contacting the cam and a second surface opposite to the first surface. The second surface of the shim has a convex spherical shape, and the second surface of the lifter has a concave spherical shape so as to receive the second surface of the shim.

9 Claims, 7 Drawing Sheets

VALVE DRIVE APPARATUS FOR AN INTERNAL COMBUSTION ENGINE HAVING A CONVEX SHIM BETWEEN A CAM AND A VALVE

BACKGROUND OF THE INVENTION

1. Field of the Invention

The present invention relates to a valve drive apparatus for an internal combustion engine and, more particularly, to a valve drive apparatus having a shim interposed between a three-dimensional cam and a lifter.

2. Description of the Related Art

A variable valve timing mechanism is known which varies a valve operation timing and an amount of valve lift in response to an operational condition of an internal combustion engine such as an engine revolution speed or engine load. The variable valve timing mechanism allows improvement in engine output and specific fuel consumption and reduction in exhaust emission.

A valve drive apparatus used in the variable valve timing mechanism comprises a three-dimensional (3-D) cam. The 3-D cam has a slanting surface which is inclined with respect to the rotational axis of the 3-D cam, and is movable along the rotational axis. Valve operation timing and an amount of valve lift are optimized by controlling an amount of shift of the 3-D cam along the rotational axis.

Japanese Laid-Open Utility Model Application No.3-42001 discloses a valve drive apparatus of the above-mentioned type. FIG. 1 shows the valve drive apparatus 1 disclosed in the above-mentioned Japanese Laid-Open Utility Model Application. The valve drive apparatus 1 generally comprises a 3-D cam 2, a valve 3, a lifter 4 and a shim 5.

The 3-D cam 2 comprises a cam portion and a cam shaft 7. A slanting surface 8 is formed on the cam portion. The slanting surface 8 of the cam portion 6 is inclined with respect to the rotational axis of the cam shaft 7 by an angle $\alpha$. The 3-D cam 2 is movable in directions indicated by arrows X1 and X2 by an actuator not shown in the figure.

The valve 3 is provided to an intake port or exhaust port of a cylinder head 10 of an engine. The valve 3 opens or closes the intake port or the exhaust port by being reciprocated by rotation of the 3-D cam 2. A retainer 9 is provided above the valve 3. The retainer 9 is urged by a spring 14 in a direction toward the cam 2. Thus the valve 3 is urged by the spring 14 in the direction toward the cam 2. In FIG. 1, the valve 3 reciprocates in directions indicated by arrows Z1 and Z2. Hereinafter, the direction Z1 may be referred to as an upward direction, and the direction Z2 may be referred to as a downward direction.

The lifter 4 is provided above the valve 3. A top surface of the lifter 4 is formed as a convex spherical surface 11 having a shape corresponding to a part of a sphere. The lifter 4 transmits a displacement of the 3-D cam 2 to the valve 3 by being guided by and reciprocated within a valve opening 10*a* of a cylinder head 10.

The shim 5 is interposed between the 3-D cam 2 and the lifter 4. The shim 5 has a flat surface 12 on the top and a concave spherical surface 13 on the bottom. The flat surface 12 contacts the 3-D cam 2. The concave spherical surface 13 engages the convex spherical surface 11 of the lifter 4. The convex spherical surface 11 and the concave spherical surface 13 have substantially the same radius of curvature. Thus, the shim 5 is rotationally slidable along the convex spherical surface 11 of the lifter 4.

In the above-mentioned structure, valve operation timing and an amount of valve lift can be varied, when the cam shaft 11 is moved by an actuator (not shown in the figure) in either direction X1 or X2, due to the slanting surface 8 formed on the 3-D cam 2. If the 3-D cam 2 moves, the shim 5 rotationally slides on the lifter 4. Thus, abrasion resistance between the lifter 4 and the shim 5 is improved since a large contact area is maintained between the lifter 4 and the shim 5 even when the 3-D cam 2 is shifted.

However, there is a problem in that the shim 5 interferes with the cylinder head 10 when the shim 5 rotationally slides along the convex spherical surface of the lifter 4. A detailed description will now be given, with reference to FIG. 2, of the reason for the interference of the shim 5 with the cylinder head 10.

FIG. 2 shows a state where the shim 5 rotationally slides on the lifter 4. It should be noted that, in FIG. 2, the shim 5 is shown protruding inside the cylinder head 10, however, practically, the shim 5 is rotatable up to a position where an end of the shim 5 contacts the cylinder head 10.

In the conventional valve drive apparatus, the center of rotation of the shim 5 is at a position indicated by O1 which is located below the shim 5 since the spherical surface 11 of the lifter 4 is convex and the spherical surface 13 of the shim 5 is concave. Thus, the shim 5 moves along an arc indicated by arrows A1 and A2 with respect to the center O1 of rotation.

Thus, the movement of the shim 5 is a movement by which the shim 5 approaches the cylinder head 10. Thus, in the conventional valve drive apparatus 1, there is a possibility that the shim 5 interferes with an inner surface of the valve opening 10*a* of the cylinder head 10 when the shim 5 rotationally slides on the lifter 4.

In order to avoid such an interference, the shim 5 must be formed in a predetermined size smaller than the diameter of the valve opening 10*a*. However, if the shim 5 is made smaller, the contact area between the shim 5 and the lifter 4 becomes smaller. As a result, the surface contact pressure between the lifter 4 and the shim 5 is increased, and causes another problem in that the abrasion resistance is decreased.

SUMMARY OF THE INVENTION

It is a general object of the present invention to provide a valve drive apparatus for an internal combustion engine in which the above-mentioned problems are eliminated.

A more specific object of the present invention is to provide a valve drive apparatus in which a shim is prevented from interfering with a cylinder head without decreasing abrasion resistance between the shim and a lifter contacting the shim.

In order to achieve the above-mentioned object, there is provided according to the present invention a valve drive apparatus for driving a valve of an internal combustion engine, the valve drive apparatus comprises:

a three-dimensional cam rotatable in synchronization with an operation of the internal combustion engine, the three-dimensional cam including a cam portion having a slanting cam surface inclined with respect to a rotational axis of the three-dimensional cam, the three-dimensional cam being movable along the rotational axis;

a force transmitting member transmitting a force generated by a camming action of the three-dimensional cam to the valve, the force transmitting member having a first surface pressing the valve and a second surface; and a shim interposed between the three-dimensional cam and the force transmitting member, the shim having a first surface contacting the three-dimensional cam and a second surface opposite to the first surface of the shim, the second surface of the shim pressing the second surface of the force transmitting member, wherein the second surface of the shim has a convex spherical shape, and the second surface of the force transmitting member has a concave spherical shape so as to receive the second surface of the shim.

According to the above-mentioned invention, when the three-dimensional cam is rotated and the slanted cam surface engages the shim, the shim is rotated or swung so that the first surface of the shim follows the slanted cam surface. Since the second surface of the shim has a convex spherical shape, the center of the radius of curvature of the second surface of the shim is positioned above the shim. In this construction, when the shim is rotated or swung, the shim moves substantially away from a cylinder head in which the force transmitting member is movably provided. Thus, interference of the shim with the cylinder head is prevented. Accordingly, a contact area between the shim and the force transmitting member can be increased. This allows a surface contact pressure between the shim and the force transmitting member to be reduced, resulting in increased abrasion resistance between the shim and the force transmitting member. Additionally, as the second surface of the force transmitting member has a concave spherical shape, lubricant is collected and remains on the second surface of the force transmitting member. Thus, friction loss between the shim and the force transmitting member is decreased, and abrasion resistance between the shim and the force transmitting member is further increased.

Preferably, a radius of curvature of the second surface of the shim is substantially equal to a radius of curvature of the second surface of the force transmitting member.

In one embodiment of the present invention, the force transmitting member may have a rim radially and outwardly extending from an outer periphery of the second surface of the force transmitting member, and the shim may have a collar radially and outwardly extending from an outer periphery of the second surface of the shim. An excessive rotation or swing of the shim can be prevented by the collar of the shim contacting the rim of the force transmitting member.

Additionally, in the present invention, a width of the cam portion of the three-dimensional cam may be less than a width of the first surface of the shim. The first surface of the shim may have a substantially circular shape, and the width of the first surface of the shim may correspond to a diameter of the first surface of the shim.

In this invention, the shim is rotated with respect to the force transmitting member substantially in the horizontal plane perpendicular to the moving direction of the force transmitting member when the three-dimensional cam is moved away from the center of the shim along the rotational axis of the three-dimensional cam. Thus, the position of the shim relative to the force transmitting member substantially in the horizontal plane is always changed. This rotation of the shim prevents local abrasion of the shim and the force transmitting member.

Additionally, in the valve drive apparatus according to the present invention, a height of the shim is less than a radius of curvature of the shim, the height of the shim being a distance from a top of the second surface of the shim to the first surface of the shim.

According to this invention, the contact area between the shim and the force transmitting member can be increased without increasing the height of the shim. Thus, the mass of inertia of the shim can be decreased as compared to a shim having a large contact area achieved by merely increasing the height of the shim. This allows a good response of the shim in a high speed operation of the engine. Additionally, since the radius of curvature of the second surface of the shim is increased, the maximum surface contact pressure is decreased, resulting in prevention of a local abrasion between the shim and the force transmission member.

In one embodiment of the present invention, the force transmitting member may comprise a rocker arm having a first end adapted to be rotatably supported by a rocker shaft and a second end contacting the valve, the second surface of the force transmitting member being formed on the rocker arm between the first end and the second end.

Other objects, features and advantages of the present invention will become more apparent from the following detailed description when read in conjunction with the accompanying drawings.

DETAILED DESCRIPTION OF THE PREFERRED EMBODIMENTS

Figure 1:
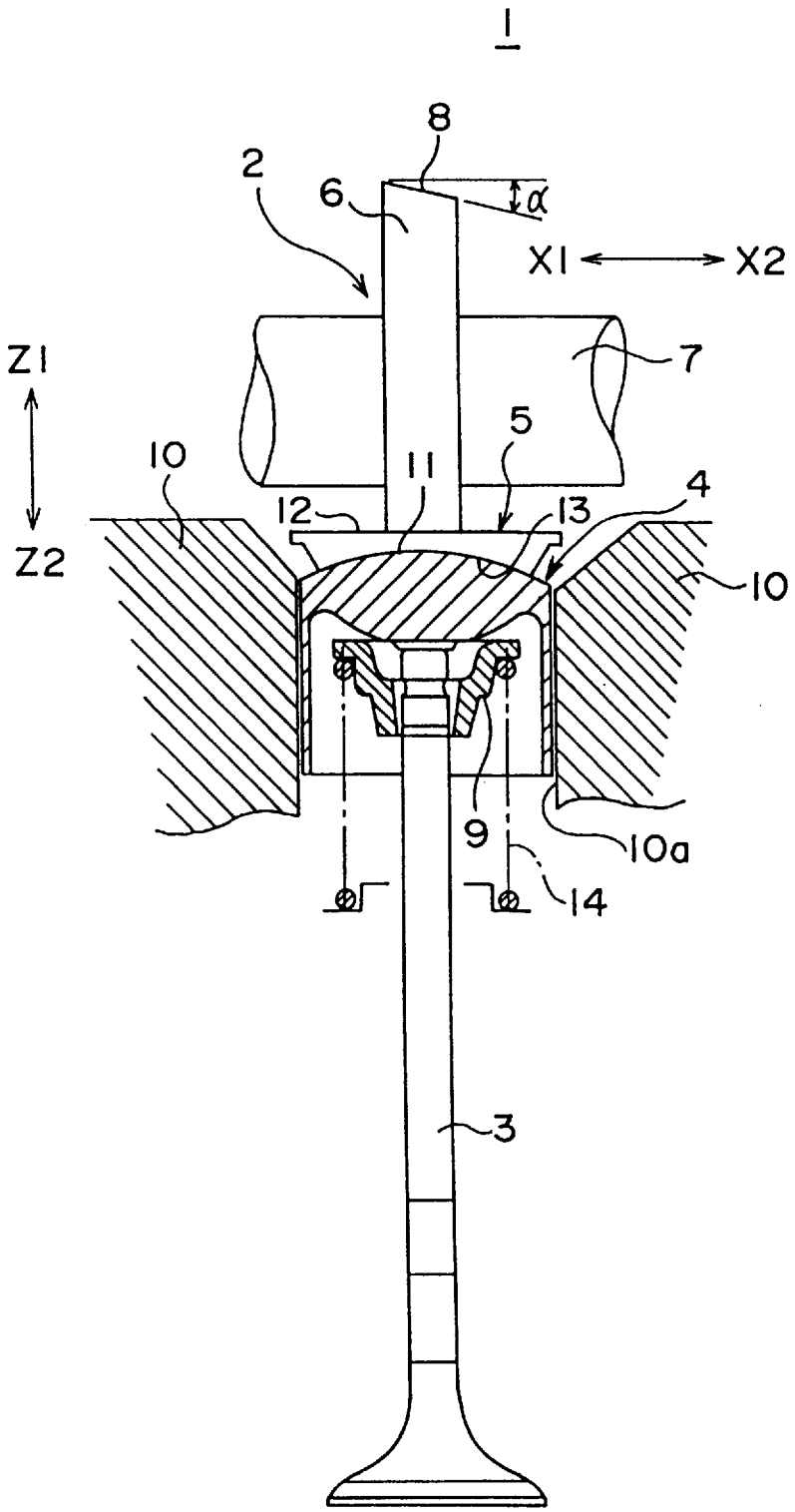
FIG. 1 PRIOR ART
FIG. 1 is a side view of a conventional valve drive apparatus.
Figure 2:
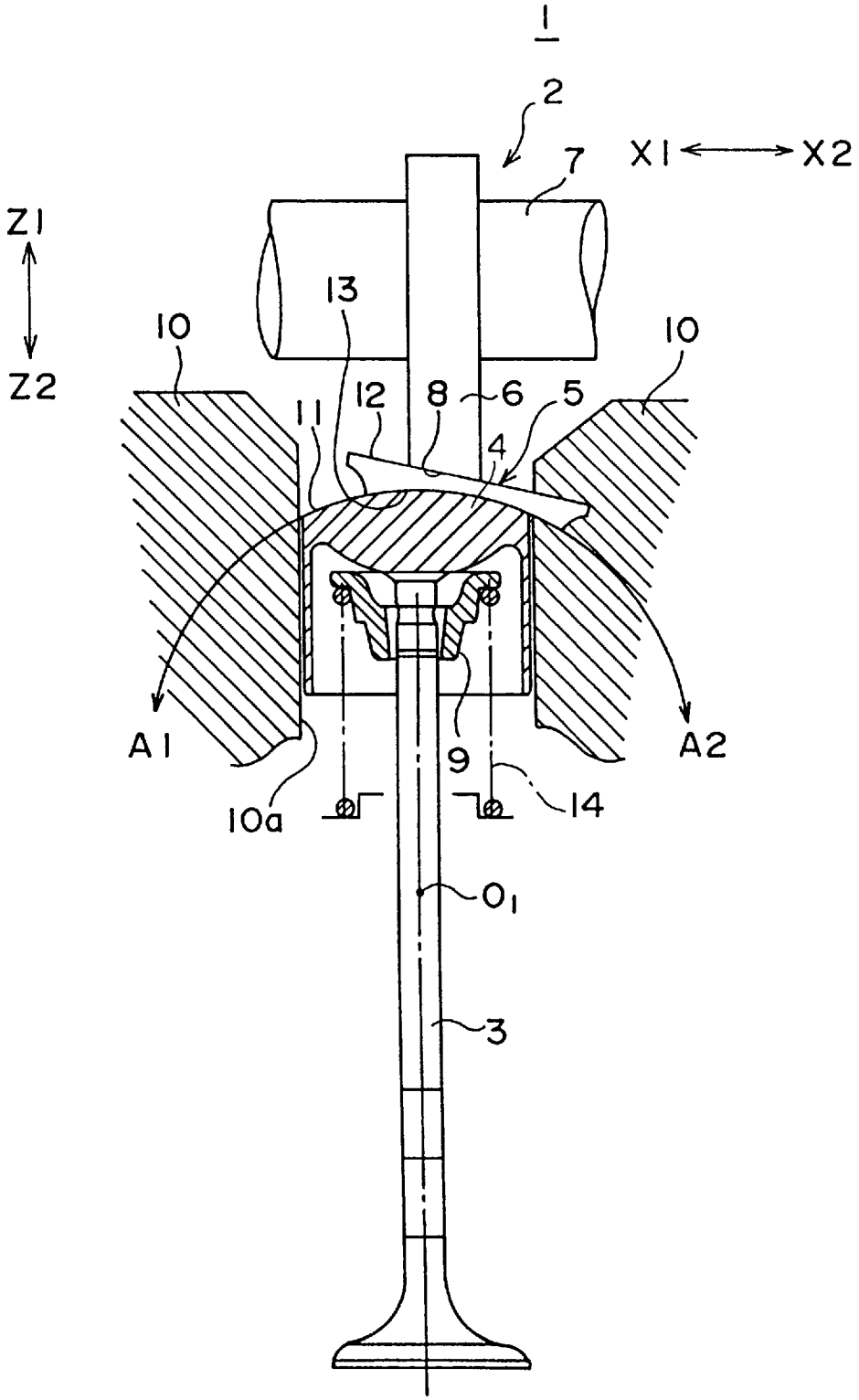
FIG. 2 PRIOR ART
FIG. 2 is a side view of the conventional valve drive apparatus in a condition where a shim is displaced.
Figure 3B:
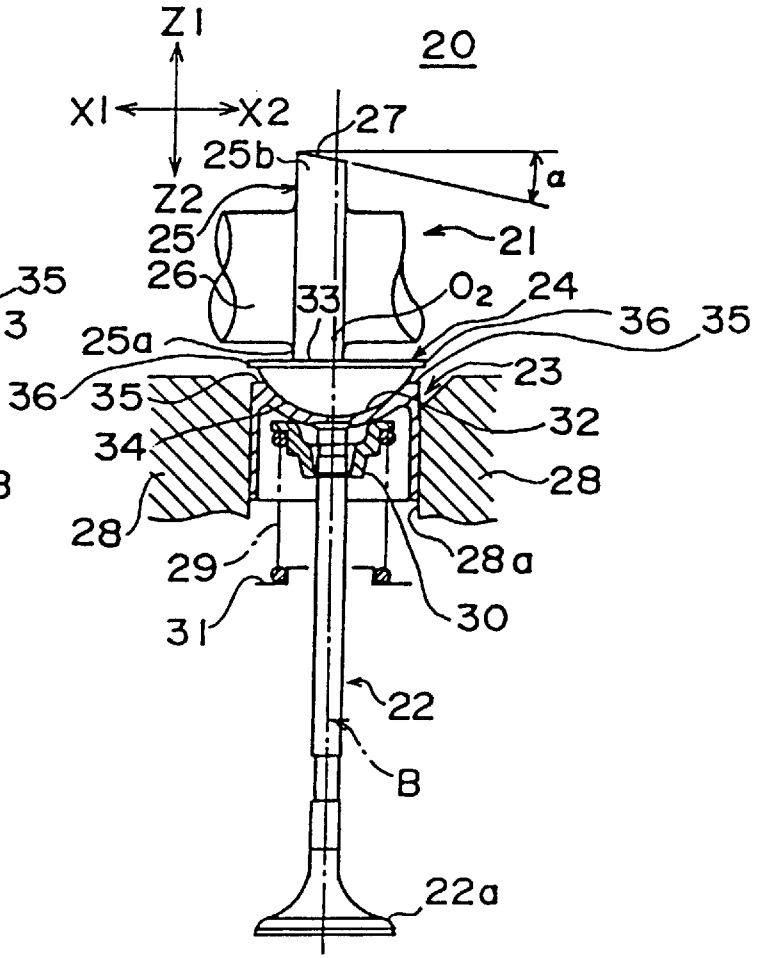
FIG. 3B is a front view of the valve drive apparatus shown in FIG. 3A.
Figure 3A:
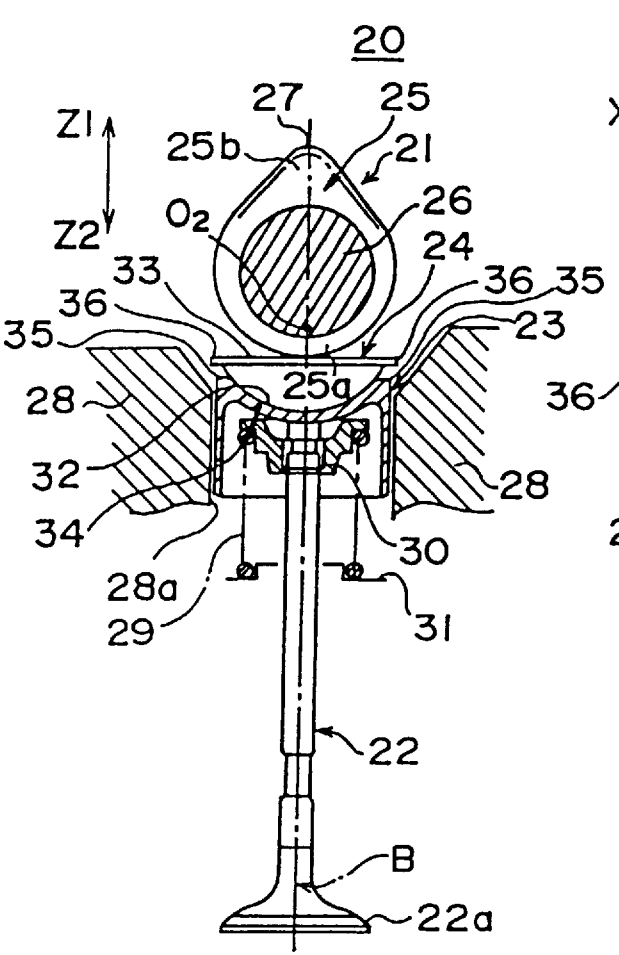
FIG. 3A is a side view of a valve drive apparatus according to a first embodiment of the present invention.

A description will now be given, with reference to FIGS. 3A and 3B, of a first embodiment of the present invention. FIG. 3A is a side view of a valve drive apparatus 20 according to the first embodiment of the present invention; and FIG. 3B is a front view of the valve drive apparatus 20 shown in FIG. 3A. The valve drive apparatus 20 is used for an internal combustion engine, and is of a directly driven valve type. The valve drive apparatus 20 generally comprises a 3-D cam 21, a valve 22, a lifter 23 and a shim 24.

The 3-D cam 21 comprises a cam portion 25 and a cam shaft 26. The cam portion 25 comprises a basic circular portion 25*a* and a cam nose 25*b* which protrudes from the basic circular portion 25*a*. A slanting surface 27 which is inclined with respect to the rotational axis (cam axis) of the 3-D cam 2 by an angle α.

The cam shaft 26 is connected to a crank shaft of the engine via timing gears and timing belts which are not shown in figures so that the cam shaft 26 is rotated in synchronization with a rotation of the crank shaft. Additionally, an actuator (not shown in the figures) is connected to an end of the cam shaft 26 so that the 3-D cam 21 is movable in either direction X1 or X2 in FIG. 3B by being driven by the actuator.

The valve 22 is provided to an intake port or an exhaust port provided in a cylinder head 28 of the internal combustion engine. A valve head 22*a* of the valve 22 opens or closes the intake port or the exhaust port by being reciprocated by a camming action of the 3-D cam 21. A retainer 30 is provided above the valve 22. The retainer 30 is urged by a valve spring 29 in a direction toward the 3-D cam 21. Thus, the valve 22 is urged by the valve spring 29 in the direction toward the 3-D cam 21. In FIGS. 3A and 3B, the valve 22 reciprocates in directions indicated by arrows Z1 and Z2. Hereinafter, the direction Z1 may be referred to as an upward direction, and the direction Z2 may be referred to as a downward direction.

The lifter 23 is provided above the valve 22, and has a cylindrical shape with a bottom surface. A top surface of the lifter 23 is formed as a concave spherical surface 32 having a shape corresponding to a part of a sphere. The lifter 23 transmits a displacement of the 3-D cam 21 to the valve 22 by being guided by and reciprocated within a valve opening 28*a* of the cylinder head 28.

The shim 24 is interposed between the 3-D cam 21 and the lifter 23. The shim 24 has a flat surface 33 on the top and a convex spherical surface 34 on the bottom. The flat surface 33 contacts the 3-D cam 21.

The convex spherical surface 34 of the shim 24 engages the concave spherical surface 32 of the lifter 23. The concave spherical surface 32 and the convex spherical surface 34 have substantially the same radius of curvature. The centers of both the concave spherical surface 32 and the convex spherical surface 34 are located at a point O2 positioned on the center axis B of the valve 22. In the present embodiment, a shim height H is less than the radius of curvature R of the convex spherical surface 34 of the shim 24, where the shim height H is a distance from a top of the convex spherical surface 34 to the flat surface 32 of the shim 24.

In the above-mentioned construction, the shim 24 is rotationally slidable along the concave spherical surface 32 of the lifter 23 while the convex spherical surface 34 contacts the concave spherical surface 32.

In the valve drive apparatus 20, a lubricant is supplied to the contact area between the 3-D cam 21 and the shim 24 and the contact area between the shim 24 and the lifter 23. In the present embodiment, the lubricant supplied between the convex spherical surface 34 of the shim 24 and the concave spherical surface 32 of the lifter 23 is positively retained in the contact area since the lifter 23 is positioned below the shim 24 and has the concave spherical surface which functions as a recess retaining the lubricant. Thus, good lubrication between the shim 24 and the lifter 23 is achieved, resulting in reduction in friction loss. That is, the abrasion resistance between the shim 24 and the lifter 23 is increased.

The contact area between the convex spherical surface 34 of the shim 24 and the concave spherical surface 32 of the lifter 23 is large since the contact is made between the spherical portions having substantially the same radius of curvature. This large area contact results in a decrease in the surface contact pressure between the shim 24 and the lifter 23. Thus, abrasion resistance is increased.

The lifter 23 has a rim 35 radially extending from the concave peripheral surface 32. The shim 24 has a collar 36 radially extending from the convex spherical surface 34. The collar 36 prevents excessive movement (rotation) of the shim 24 by contacting the rim 35 of the lifter 23 so that the shim 24 does not come out from the area between the shim 24 and the lifter 23.

Additionally, in the valve drive apparatus 20 according to the present invention, the diameter L1 of the flat surface 33 of the shim 24 is greater than a width L2 of the cam portion 25 of the 3-D cam 21 (L1>L2). Hereinafter, the diameter L1 may be referred to as a shim width L1, and the width L2 may be referred to as a cam width L2.

Figure 4B:
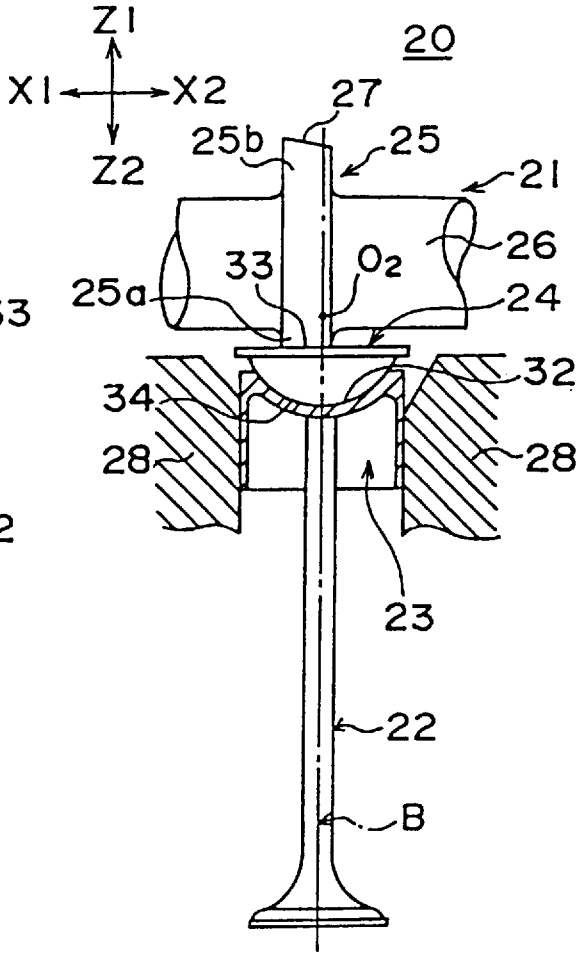
FIG. 4B is a front view of the valve drive apparatus shown in FIG. 4A.
Figure 4A:
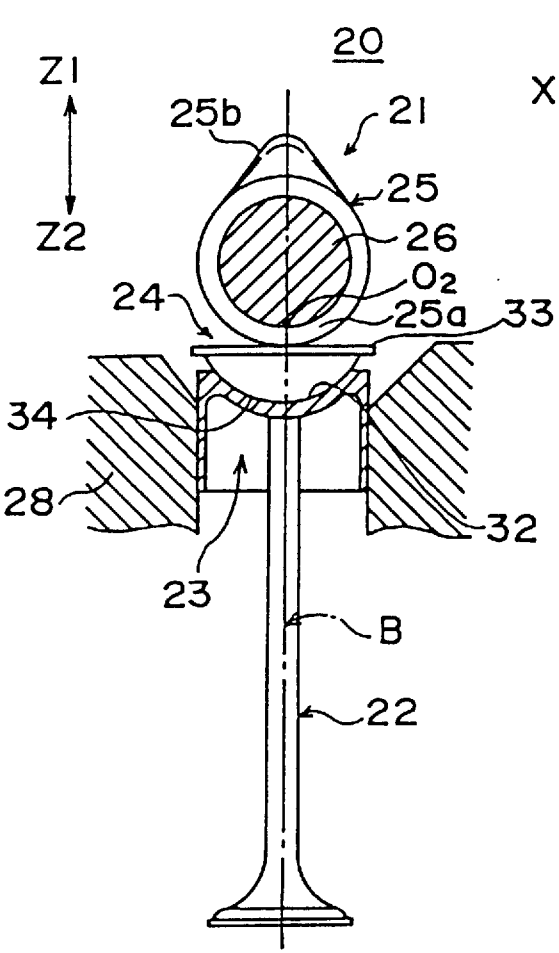
FIG. 4A is a side view of the valve drive apparatus shown in FIG. 3A in a state where a shim contacts a basic circular portion of a cam portion.
Figure 5B:
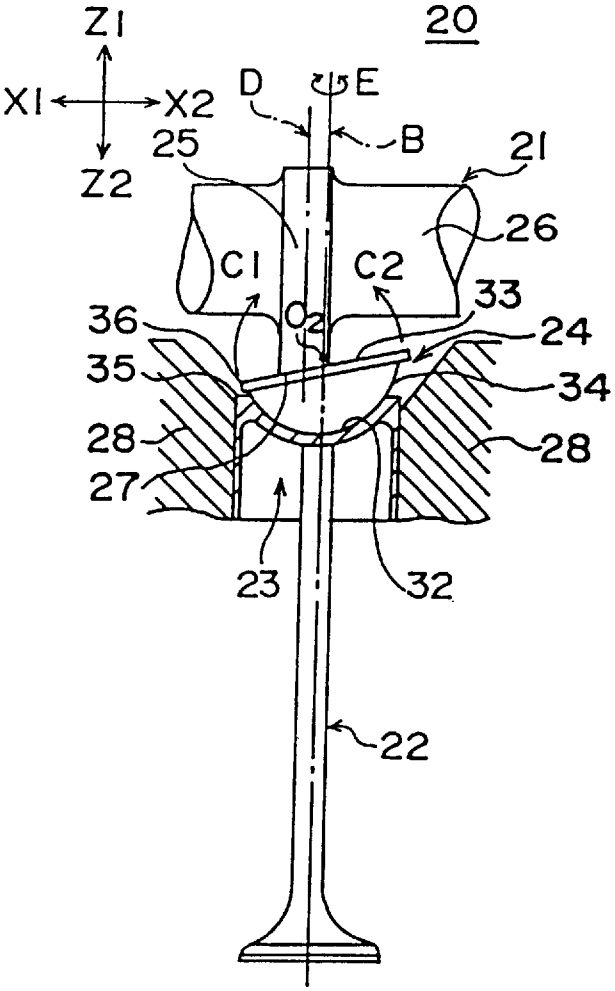
FIG. 5B is a front view of the valve drive apparatus shown in FIG. 5A.
Figure 5A:
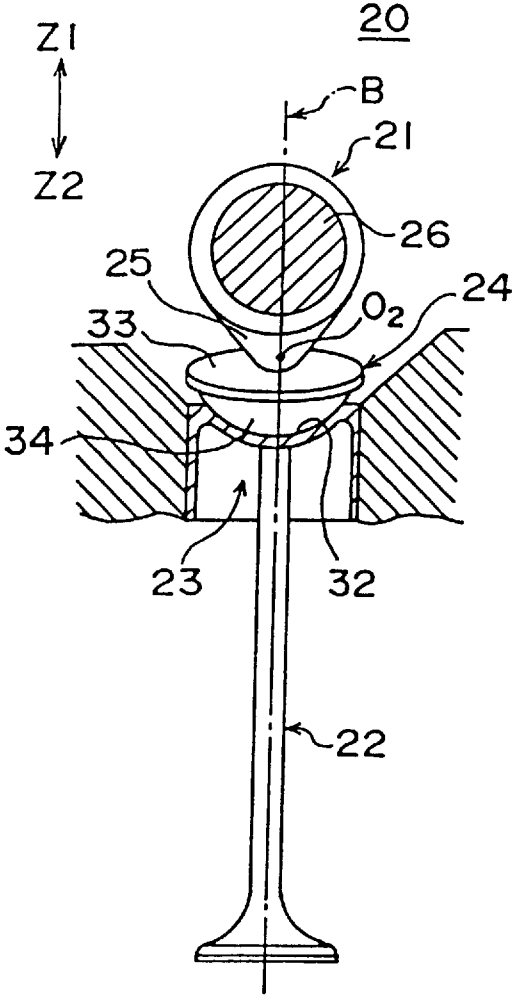
FIG. 5A is a side view of the valve drive apparatus shown in FIG. 3A in a state where the shim contacts a cam nose of the cam portion.

A description will now be given, with reference to FIGS. 4A, 4B, 5A and 5B, of an operation of the valve drive apparatus. FIGS. 4A and 4B show a state where the shim 24 contacts the basic circular portion 25*a* of the cam portion 25. FIGS. 5A and 5B show a state where the shim 24 contacts the cam nose 25 of the cam portion 25. In FIGS. 4A, 4B, 5A and 5B, the valve spring 29, the retainer 30 and the valve seat 31 are omitted for the sake of simplification of illustration.

As mentioned above, the 3-D cam 21 rotates in synchronization with the crank shaft of the engine. Thus, when the cam portion 25 presses the shim 24 by being rotated from the state shown in FIGS. 4A and 4B, a pressing force is transmitted to the lifter 23 via the shim 24. Thus, the valve 22 is pressed via the lifter 23 and moved in the Z2 direction. Additionally, as also mentioned above, the cam portion 25 has the slant surface 27 formed on the cam nose 25*b*, and the shim 24 can be rotatably moved along the concave spherical portion 32 of the lifter 23. Thus, when the slant surface 27 comes in contact with the flat surface 33 as the 3-D cam 21 rotates, the shim 24 rotates or is inclined with respect to the lifter 23, as shown in FIGS. 5A and 5B, so that the entire slant surface 27 contacts the flat surface 33.

The cam shaft 26 can be moved in either the X1 direction or X2 direction by an actuator not shown in the figures. Additionally, the slant surface 27 is formed on the cam nose 25*b*. Accordingly, the amount of valve lift of the valve 22 can be controlled by the cam shaft 26 being moved in the X1 direction or the X2 direction.

More specifically, the amount of valve lift of the valve 22 is decreased when the cam shaft 26 is moved in the X1 direction, resulting in a short travel of the valve 22 which condition is suitable for low speed operation of the engine which requires a lower amount of flow through the valve. On the other hand, the amount of valve lift of the valve 22 is increased when the cam shaft 26 is moved in the X2 direction, resulting in a longer travel of the valve 22 which condition is suitable for a high speed operation which requires a larger amount of flow.

A description will now be given in more detail of a rotational movement of the shim 24 along the concave spherical surface 32 of the lifter 23 due to engagement of the slant surface 27 of the 3-D cam 21 with the flat surface 33 of the shim 23.

As mentioned above, the center of the radius of curvature of the concave spherical surface 32 of the lifter 23 is positioned at the same position O2 with the center of the radius of curvature of the convex spherical surface 34 of the shim 24. The center O2 of the radius of curvature is positioned on the center axis B of the valve 22. Accordingly, the shim 24 can rotatably slide on the concave spherical surface 32 of the lifter 23. This enables the rotation of the shim 5 to be parallel to the slant surface 27 as shown in FIG. 5B.

In the present embodiment, since both the convex spherical surface 34 of the shim 24 and the concave spherical surface 32 of the lifter 23 are closed downwardly, the center O2 of the surfaces 32 and 34 is above the shim 24. Thus, the shim 24 rotates about the center O2 in either direction indicated by arrows C1 or C2 shown in FIG. 5B.

The rotational movement of the shim 24 is a movement by which the shim 24 moves away from the cylinder head 28. Thus, the shim 24 does not interfere with the cylinder head 28 as is in the conventional valve drive apparatus in which the rotational direction of the shim is a direction which approaches the cylinder head.

Additionally, since the interference of the shim 24 with the cylinder head 28 is prevented, the contact area between the shim 24 and the lifter 23 can be increased so as to decrease surface contact pressure between the shim 24 and the lifter 23.

A description will now be given of an effect obtained by the shim width L1 being greater than the cam width L2.

As mentioned above, the cam portion 25 can be moved on the flat surface 33 of the shim 24 by setting the shim width L1 to be grater than the cam width L2. Specifically, the cam portion 25 can be moved a distance in a range of (L1–L2) in the direction L1 or L2.

If the shim width L1 is less than the cam width L2, the entire cam surface of the cam portion 25 contacts the flat surface 33. In this case, the rotational force generated in the shim 24 is only in the direction C1 or C2. On the other hand, if the shim width L1 is greater than the cam width L2 as is in the present embodiment, the center line D (hereinafter, referred to as a cam side contact center line B) of the contact area between the shim 24 and the lifter 23 is offset from the center axis of the lifter 23. The center axis of the lifter 23 corresponds to the center axis B of the valve 22 as shown in FIG. 5B, and is hereinafter referred to as a lifter side contact center line. In FIG. 5B, the cam side contact center line D is offset from the lifter side contact center line B by a distance dL.

In the above-mentioned construction, a rotational force is generated in the shim 24 by which rotational force the shim 24 is rotated about the lifter side contact center line B in a direction E indicated by arrows E in FIG. 5B.

Since the shim 24 can be rotated in any direction with respect to the lifter 23 as mentioned above, the shim 24 can be rotated about the lifter side contact center line B in either direction E by the rotational force generated by the cam side contact center line D being offset from the lifter side contact center line B.

When the shim 24 is rotated in the direction E, the contact point of the shim 24 with respect to the cam portion 25 is shifted in the direction E. This prevents the shim 24 from contacting the cam portion 25 always in the same area of the flat surface 33. Thus, the flat surface 33 of the shim 24 is prevented from being worn only in a particular area of the flat surface 33. This increases reliability of the valve drive apparatus 20. Additionally, since the shim 24 is rotated in the direction E with respect the lifter 23, the convex spherical surface 34 of the shim 24 and the concave spherical surface 32 of the lifter 23 are also worn evenly over the entire contact area.

There is a possibility that when the shim 24 having the concave spherical surface 34 is moved excessively, the shim 24 may come out of the lifter 23. However, in the present embodiment, since the rim 35 is formed on the lifter 23 and the collar 36 is formed on the shim 24, an excessive movement of the shim 24 is prevented. That is, the excessive movement of the shim 24 is prevented by the collar 36 of the shim 24 from contacting the rim 35 of the lifter 23. This also increases reliability of the valve drive apparatus 20.

Figure 6B:
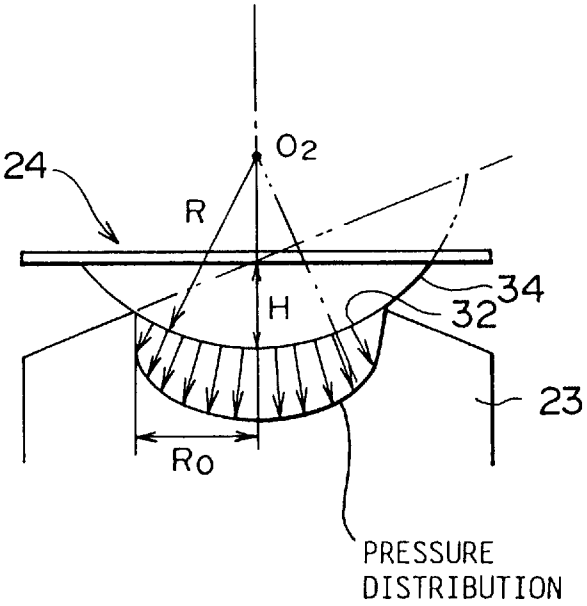
FIG. 6B is an illustration of a distribution of the surface contact pressure between the shim and the lifter in a state where the radius of curvature of the shim is greater than the height of the shim.
Figure 6A:
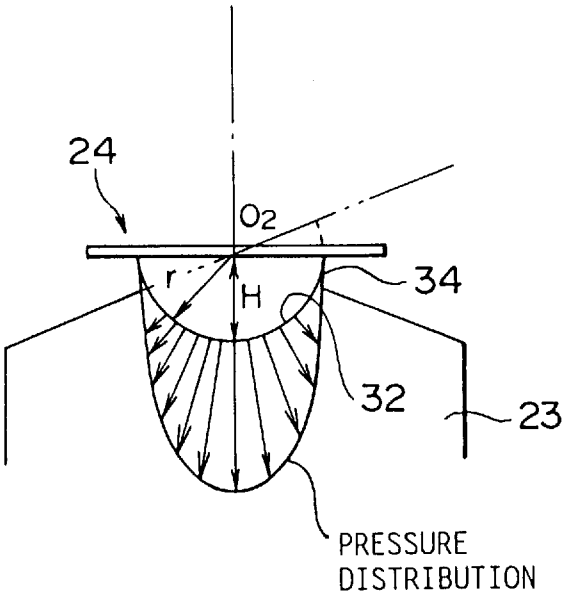
FIG. 6A is an illustration for a distribution of the surface contact pressure between the shim and a lifter in a state where the radius of curvature of the shim is substantially the same with a height of the shim.

A description will now be given, with reference to FIGS. 6A and 6B, of the effect achieved by the shim height H being less than the radius of curvature R of the shim 24. FIG. 6A shows a distribution of the surface contact pressure between the shim 24 and the lifter 23 in a state where the radius of curvature r of the shim 24 is substantially the same with the shim height H. FIG. 6B shows a distribution of the surface contact pressure between the shim 24 and the lifter 23 in a state where the radius of curvature R of the shim 24 is greater than the shim height H.

The surface contact pressure between the concave spherical surface 32 and the convex spherical surface 34 can be obtained by using a method for calculating a bearing pressure in a bearing. A bearing pressure P in a bearing can be calculated by dividing a force F applied to the bearing by a projected area S of the bearing (P=F/S). By using this relationship, the surface contact pressure P can be calculated by dividing a pressing force F applied to the shim 24 by the 3-D cam 21 by a projected area S of the convex spherical surface 34.

Referring to the structure shown in FIG. 6A, the projected area S1 of the convex spherical area 34 is calculated by $S1=\pi\times r^2$. Accordingly, the surface contact pressure P1 between the concave spherical surface 32 and the convex spherical surface 34 in this case can be obtained by the following equation (1).

$$P1=F/(\pi\times r^2) \quad (1)$$

On the other hand, in the structure shown in FIG. 6B, the surface contact pressure P2 can be obtained as follows. It is assumed that the pressing force F and the shim height H are the same as that of the structure shown in FIG. 6A so as to facilitate a comparison therebetween. The projected area S2 of the convex spherical surface 34 is obtained as $S2=\pi\times R_0^2$. Thus, the surface contact pressure P2 can be obtained by the following equation (2).

$$P2=F/(\pi\times R_0^2) \quad (2)$$

Now, a comparison is made between the surface contact pressure P1 obtained in the structure shown in FIG. 6A and the surface contact pressure P2 obtained in the structure shown in FIG. 6B which corresponds to the present embodiment. As mentioned above, in the present embodiment, the shim height H is less than the radius of curvature R of the convex spherical surface 34 (H<R). Thus, if it is assumed that the shim height H is equal between the structures shown in FIGS. 6A and 6B, a relationship $r<R_0<R$ is established as apparent from FIGS. 6A and 6B. Accordingly, if the projected areas S1 and S2 are compared with each other, a relationship S1<S2 is established. By applying the above relationships to the equations (1) and (2), a relationship P1>P2 is established.

As mentioned above, the surface contact pressure P2 of the present embodiment is smaller than the surface contact pressure of the structure shown in FIG. 6A by setting shim height H to be smaller than the radius of curvature R of the shim 224. This reduces abrasion between the shim 24 and the lifter 23.

Additionally, since the contact area S2 between the shim 24 and the lifter 23 can be increased without increasing the shim height H, inertial mass of the valve drive system can be reduced as compared to the structure in which the contact area is increased by increasing the shim height H. Thus, a quick response of the valve drive apparatus 20 at high speed operation of the engine can be achieved.

Now, attention is directed to a distribution of the surface contact pressure. The variation in the distribution of the surface contact pressure of the structure of the present embodiment shown in FIG. 6B is smaller than that of the structure shown in FIG. 6A, specifically, the maximum surface contact pressure of the structure shown in FIG. 6B is smaller than the maximum surface contact pressure of the structure shown in FIG. 6A, and the variation in the distribution of the surface contact pressure of the structure shown in FIG. 6B is smaller than that of the structure shown in FIG. 6A. That is, the surface contact pressure of the present embodiment is distributed evenly as compared to the structure shown in FIG. 6A.

As mentioned above, the maximum surface contact pressure between the shim 24 and the lifter 23 can be reduced by increasing the radius of curvature R of the convex spherical surface 34 with respect to the shim height H of the shim 24. Thus, concentration of the surface contact pressure to a local area is prevented, resulting in preventing local abrasion of the convex spherical surface 34 of the shim 24 and the concave spherical surface of the lifter 23.

Figure 7B:
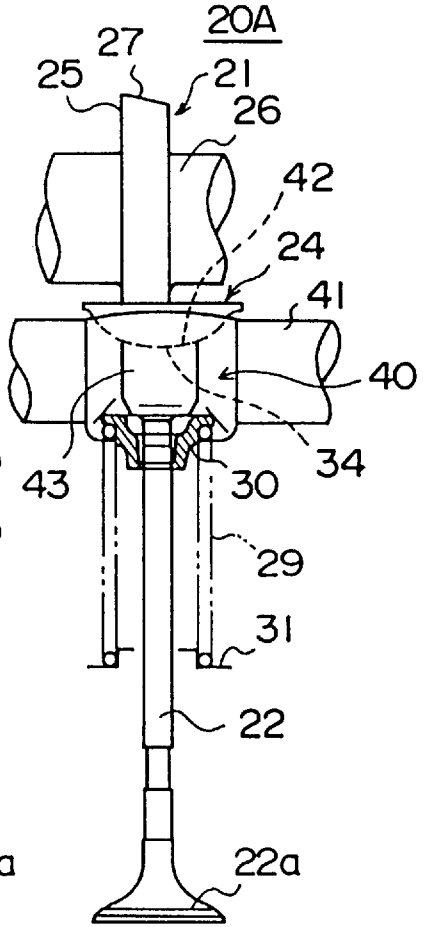
FIG. 7B is a front view of the valve drive apparatus shown in FIG. 7A.
Figure 7A:
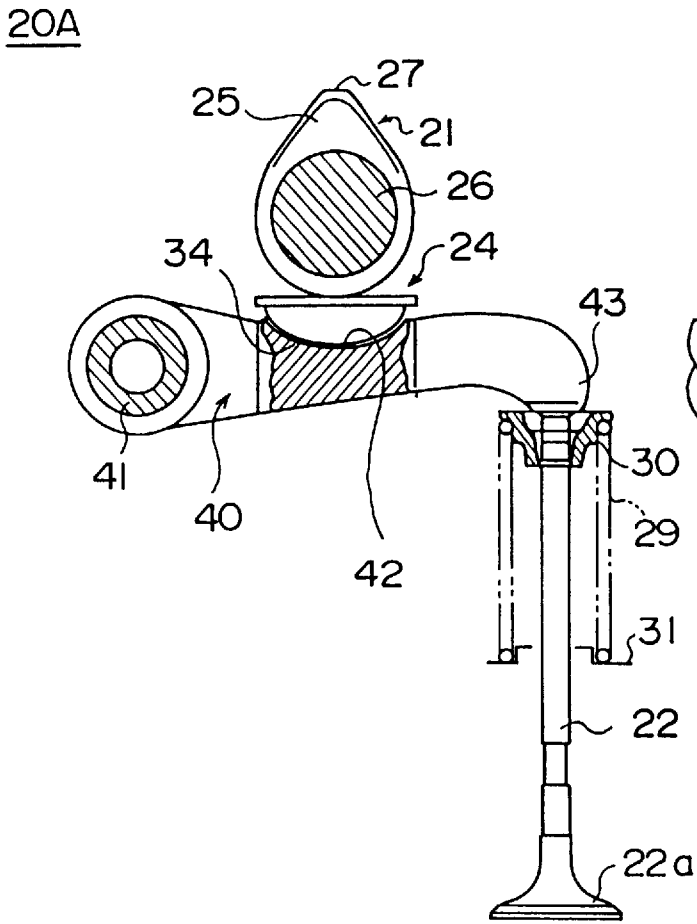
FIG. 7A is a side view of a valve drive apparatus according to a second embodiment of the present invention.

A description will now be given, with reference to FIGS. 7A and 7B, of a second embodiment of the present invention. FIG. 7A is a side view of a valve drive apparatus 20A according to the second embodiment of the present invention; FIG. 7B is a front view of the valve drive apparatus 20A shown in FIG. 7A. In FIGS. 7A and 7B, parts that are the same as the parts shown in FIGS. 3A and 3B are given the same reference numerals, and description thereof will be omitted. In the valve drive apparatus 20A according to the second embodiment, a rocker arm 40 is provided as a force transmitting member which transmits a pressing force from the 3-D cam 21 to the valve 22.

One end of the rocker arm 40 is rotatably supported by a rocker shaft 41. The other end of the rocker arm 40 is formed as an acting portion 43 which contacts an upper end of the valve 22. A concave spherical surface 42, which is similar to the concave spherical portion 32 of the first embodiment, is formed on the rocker arm 40 between the rocker shaft 41 and the acting portion 43. The shim 24 is provided on the concave spherical portion 42.

The 3-D cam 21 is provided above the shim 24 so that the shim 24 is pressed when the 3-D cam 21 is rotated by a rotation of the cam shaft 26. Thus, the pressing force is transmitted to the valve 22 via the rocker arm 40 so that the displacement of the shim 24 is increasingly transmitted to the valve 22 due to a leverage action. In the present embodiment, the shim 24 is rotatably movable on the concave spherical surface 42 similar to the above-mentioned first embodiment. Thus, the present embodiment has the same effects and advantages with the first embodiment. Accordingly, local abrasion between the shim 24 and the concave spherical surface 42 of the rocker arm 40 can be prevented.

The present invention is not limited to the valve drive apparatus of the direct drive type or the rocker arm drive type as described in the above-mentioned embodiments. For example, the present invention may be applied to a valve drive apparatus of a swing arm drive type, or further, to a cam drive apparatus other than the valve drive apparatus for an internal combustion engine.

The present invention is not limited to the specifically disclosed embodiments, and variations and modifications may be made without departing from the present invention.

What is claimed is:

1. A valve drive apparatus for driving a valve of an internal combustion engine, said valve drive apparatus comprising:

a three-dimensional cam rotatable in synchronization with operation of said internal combustion engine, said three-dimensional cam including a cam portion having a slanting surface inclined with respect to a rotational axis of said three-dimensional cam, said three-dimensional cam being movable along said rotational axis;

a force transmitting member transmitting a force generated by a camming action of said three-dimensional cam to said valve, said force transmitting member having a first surface pressing said valve and a second surface; and a shim interposed between said three-dimensional cam and said force transmitting member, said shim having a first surface contacting said three-dimensional cam and a second surface opposite to said first surface of said shim, said second surface of said shim pressing said second surface of said force transmitting member, wherein said shim is rotatable over an entire profile of said three-dimensional cam in any direction so that the first surface of the shim always aligns with the slanting surface of the cam portion, and wherein a width of said first surface of shim is greater than a width of the cam portion;

said second surface of said shim having a convex spherical shape, and said second surface of said force transmitting member having a concave spherical shape so as to receive said second surface of said shim.

2. The valve drive apparatus as claimed in claim 1, wherein a radius of curvature of said second surface of said shim is substantially equal to a radius of curvature of said second surface of said force transmitting member.

3. The valve drive apparatus as claimed in claim 1, wherein said force transmitting member has a rim radially and outwardly extending from an outer periphery of said second surface of said force transmitting member, and said shim has a collar radially and outwardly extending from an outer periphery of said second surface of said shim.

4. The valve drive apparatus as claimed in claim 1, wherein a width of said cam portion of said three-dimensional cam is less than a width of said first surface of said shim.

5. The valve drive apparatus as claimed in claim 4, wherein said first surface of said shim has substantially a circular shape, and said width of said first surface of said shim corresponds to a diameter of said first surface of said shim.

6. The valve drive apparatus as claimed in claim 1, wherein a height of said shim is less than a radius of curvature of said shim, said height of said shim being a distance from a top of said second surface of said shim to said first surface of said shim.

7. The valve drive apparatus as claimed in claim 1, wherein said force transmitting member comprises a rocker arm having a first end adapted to be rotatably supported by a rocker shaft and a second end contacting said valve, said second surface of said force transmitting member being formed on said rocker arm between said first end and said second end.

8. The valve drive apparatus as claimed in claim 1, wherein said shim is rotatable about an axis substantially parallel to a direction of motion of the valve.

9. A valve drive apparatus for driving a valve of an internal combustion engine, said valve drive apparatus comprising:

a three-dimensional cam rotatable in synchronization with operation of said internal combustion engine, said three-dimensional cam including a cam portion having a slanting surface inclined with respect to a rotational axis of said three-dimensional cam, said three-dimensional cam being movable along said rotational axis;

a force transmitting member transmitting a force generated by a camming action of said three-dimensional cam to said valve, said force transmitting member having a first surface pressing said valve and a second surface, wherein said force transmitting member has a rim extending outward from at least a portion of a circumference thereof; and a shim interposed between said three-dimensional cam and said force transmitting member, said shim having a first surface contacting said three-dimensional cam and a second surface opposite to said first surface of said shim, said second surface of said shim pressing said second surface of said force transmitting member, wherein said shim is rotatable over an entire profile of said three-dimensional cam in any direction so that the first surface of the shim always aligns with the slanting surface of the cam portion, and wherein a width of said first surface of shim is greater than a width of the cam portion and wherein said shim includes a collar extending outward from at least a portion of a circumference thereof so that contact between the collar and the rim limit the motion of said shim relative to said force transmitting member;

said second surface of said shim having a convex spherical shape, and said second surface of said force transmitting member having a concave spherical shape so as to receive said second surface of said shim.

* * * * *